US006651645B1

(12) United States Patent
Nunez Suarez

(10) Patent No.: US 6,651,645 B1
(45) Date of Patent: Nov. 25, 2003

(54) PRESSURIZED COMBUSTION AND HEAT TRANSFER PROCESS AND APPARATUS

(76) Inventor: René Maurico Nunez Suarez, Colonia San Benito Pasaje 6 #131, San Salvador (SV)

( * ) Notice: Subject to any disclaimer, the term of this patent is extended or adjusted under 35 U.S.C. 154(b) by 150 days.

(21) Appl. No.: 09/762,571

(22) PCT Filed: Jun. 1, 2000

(86) PCT No.: PCT/CA00/00658

§ 371 (c)(1),
(2), (4) Date: May 15, 2001

(87) PCT Pub. No.: WO00/75564

PCT Pub. Date: Dec. 14, 2000

Related U.S. Application Data

(60) Provisional application No. 60/138,009, filed on Jun. 8, 1999.

(51) Int. Cl.[7] ..... F23B 1/36; F23C 3/00

(52) U.S. Cl. ..... 126/9 R; 126/50; 431/353

(58) Field of Search ..... 126/25 R, 9 R, 126/50, 25 B, 222; 431/350, 115, 353, 157; 110/251

(56) References Cited

U.S. PATENT DOCUMENTS

| | | | | | |
|---|---|---|---|---|---|
| 607,642 | A | * | 7/1898 | Botelho | 126/25 R |
| 1,952,227 | A | * | 3/1934 | Adams | 110/251 |
| 4,217,132 | A | | 8/1980 | Burge | |
| 4,989,549 | A | | 2/1991 | Korenberg | |
| 5,540,212 | A | * | 7/1996 | Stroud | 126/25 R |
| 5,799,590 | A | * | 9/1998 | Noguchi | 110/251 |

FOREIGN PATENT DOCUMENTS

| | | | | |
|---|---|---|---|---|
| BE | 568532 | A | 6/1958 | |
| DE | 917803 | C | 9/1954 | |
| EP | 145381 | A2 * | 6/1985 | 431/350 |
| EP | 0853215 | A | 7/1998 | |
| FR | 2517413 | A * | 6/1983 | |

* cited by examiner

*Primary Examiner*—Sara Clarke

(57) ABSTRACT

The present invention is concerned with combustion and heat transfer processes and apparatus. The invention has general applicability in the fields of combustion and heat transfer and is applicable to industrial and non-industrial processes as well as residential use. Practical industrial application of the invention may be found in the field of steam generation for heating and for electrical power generation. In addition, non-industrial applications of the invention include cooking appliances, stoves, water heaters, furnaces and the like.

12 Claims, 9 Drawing Sheets

PRESSURIZED COMBUSTION AND HEAT TRANSFER PROCESS AND APPARATUS

CROSS-REFERENCE TO RELATED APPLICATIONS

This application claims priority benefits of U.S. Provisional Application Serial No. 60/138,009 filed Jun. 8, 1999 and the subsequent PCT filing of PCT/CA00/00658 filed Jun. 1, 2000 under the provisions of 35 U.S.C. §119(e).

FIELD OF THE INVENTION

The present invention is concerned with combustion and heat transfer processes and apparatus. The invention has general applicability in the fields of combustion and heat transfer and is applicable to industrial and non-industrial processes as well as residential use. Practical industrial application of the invention may be found in the field of steam generation for heating and for electrical power generation. In addition, non-industrial applications of the invention include cooking appliances, stoves, water heaters, furnaces and the like.

BACKGROUND OF THE INVENTION

Efficient use of heat generated from a fuel involves two fundamental steps. This first is the combustion of the fuel, and the second is the heat transfer from the products of combustion to the desired heat sink. Combustion processes are carried out so that the ambient temperature in the combustion area is extremely high, i.e., typically greater than 1500° C. It is well known that at high temperatures, nitrogen present in fuel and air reacts with oxygen to forms various oxides, commonly referred to as $NO_x$. The generation of $NO_x$ increases with the temperature, especially when an excess of oxygen is present. It is therefore desirable, when dealing with combustion of fuel, to maintain temperatures as low as possible to inhibit the formation of pollutants like $NO_x$. An alternative is to reduce the concentration of oxygen below the stoichiometric requirement.

In many areas of the world, wood is still used as the main fuel for cooking. This is particularly true for so-called lesser-developed countries where access to other fuels may not be readily available, or affordable.

To inhibit the formation of pollutants during combustion, and to efficiently utilize available fuels, it is desirable to develop appliances in which there is efficient combustion of the fuel and simultaneous efficient heat transfer of the heat generated during the combustion process to an appropriate heat sink.

SUMMARY OF THE INVENTION

In accordance with the invention, there is provided a heating apparatus comprising a housing having a general axis. The apparatus further comprises a fuel support surface. The apparatus comprises a plurality of air injectors arranged on the support surface. The air injectors have a plurality of apertures to deliver air in a first direction substantially parallel to the axis of the housing and in a second direction substantially normal to the axis of the housing. Fuel is burned adjacent the fuel support surface. Air is injected with a fan from an air inlet chamber to the air injectors. In addition, the heating apparatus preferably comprises a restrictor ring placed within the housing above the fuel support surface to restrict the cross-sectional area of the housing adjacent the restrictor ring. Further, the apparatus comprises a support means for supporting a heat sink adjacent the upper portion of the combustion chamber. There is a thermal transfer gap between the upper edge of the combustion chamber and the lower edge of the heat sink so that gases passing upwardly through the housing impinge upon the heat sink and pass through the thermal transfer gap after transferring the heat contained therein to the heat sink.

IN THE DRAWINGS

DETAILED DESCRIPTION OF THE INVENTION

In order that the invention may be more clearly understood, reference is made by way of example to a preferred embodiment of the invention which is illustrated in the accompanying drawings.

Figure 1:
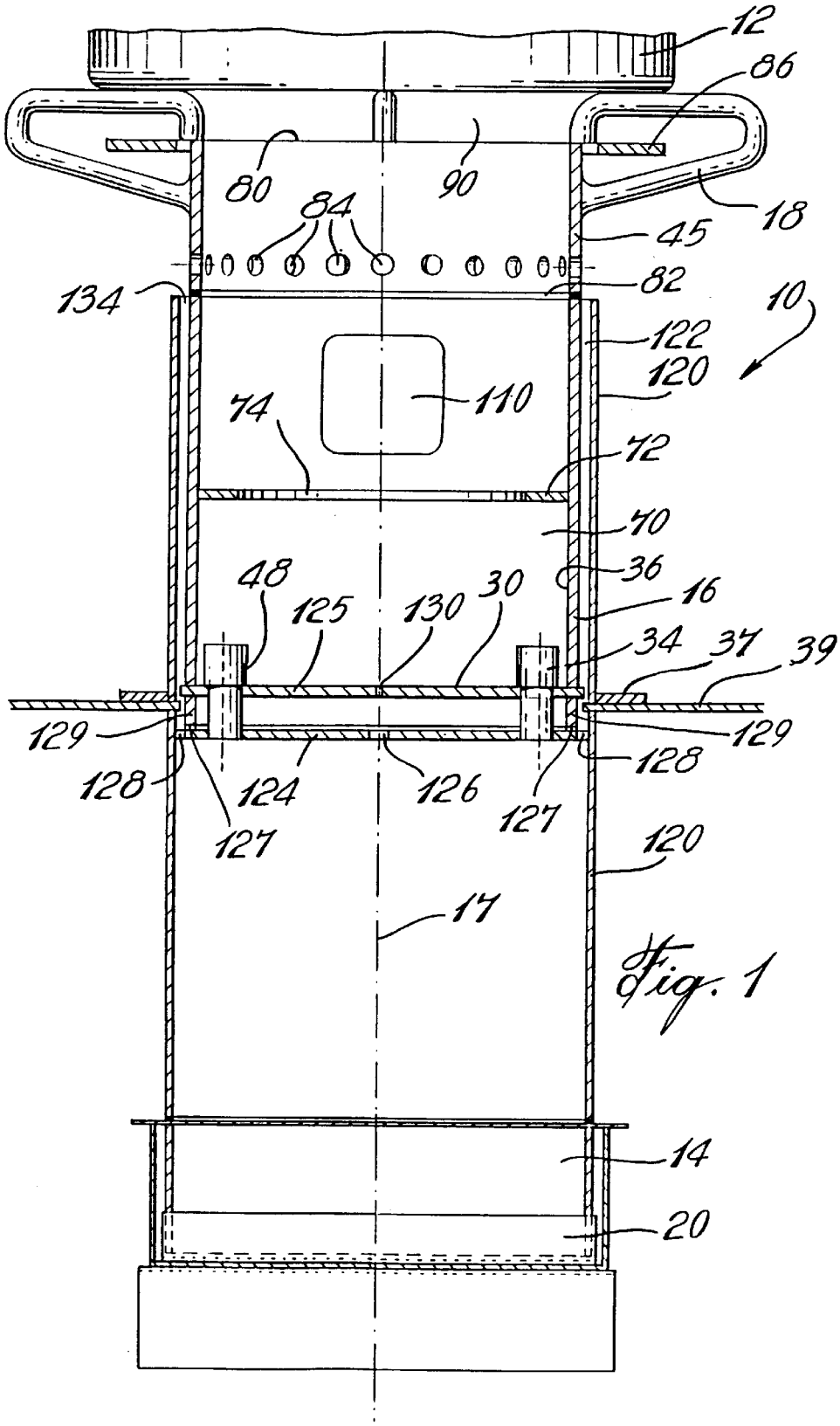
FIG. 1 is a vertical cross section of a heating device according to a preferred embodiment of the invention.

The apparatus 10 illustrated in FIG. 1 is a heating apparatus transferring heat to a heat sink. The heating apparatus 10 is a wood fired cook stove transferring heat to a heat sink 12. In this case, the heat sink 12 is in the form of a cooking pan such as fry pan. The particular configuration of heat sink 12 to be heated by the apparatus does not form part of the invention, and can take any shape, whether flat, concave or otherwise. However, the relationship between the heat sink and the relevant portions of the heating apparatus 10 are important in the heat transfer process which will be discussed more fully below.

Heating apparatus 10 comprises an air inlet chamber 14, a housing 16 and a heat sink support 18. The air inlet chamber 14 comprises a fan 20 driven by a conventional electric motor (not shown) that may be battery driven, powered by an alternate electric source or by a winding mechanism supplying the required electric energy. Fan 20 draws air axially into the lower portion of air inlet chamber 14 and directs the air to flow axially upwardly from air inlet chamber 14 into housing 16. Air inlet chamber 14 further comprises an adjustable air flow valve (not shown).

Housing 16 comprises a fuel support surface 30. Steps to reduce heat losses through the housing 16 obviously increase the efficiency of the heating unit. Accordingly, it is preferred that the inner wall 36 reflects radiated heat back to the combustion gases. A further tubular member 120 is provided around housing 16, defining an area 122 therebetween extending throughout the length of housing 16. Support plate 30 is divided into 2 separate plates 124 and 125 inside housing 16 between the combustion chamber and the air inlet chamber 14. Plate 124 comprises a central opening 126 and a plurality of openings 128 around its circumference. Plate 125 is also provided with a central opening 130. Plates 124 and 125 are coupled by a tubular member 129 that forms a narrow gap 127. Air is forced to pass through aperture 126 and impinges on plate 125, making an air stream 101 passing through gap 127 and mixes with air coming through openings 128, thereby forming air stream 132 before ultimately exiting through circular gap 134. Air also passes through aperture 130 and flows upwardly along with stream 100 (see FIGS. 1 and 5.) Injectors 34 extend throughout both plates 124 and 125.

Figure 2:
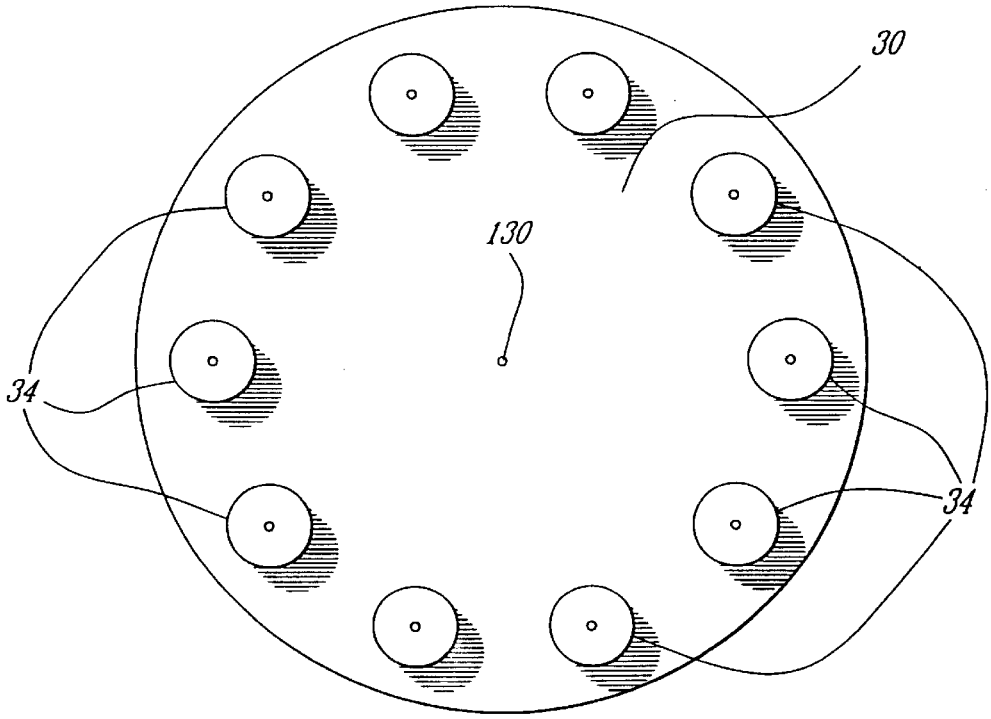
FIG. 2 is a plan view of the air injection system of the apparatus shown in FIG. 1.
Figure 11:
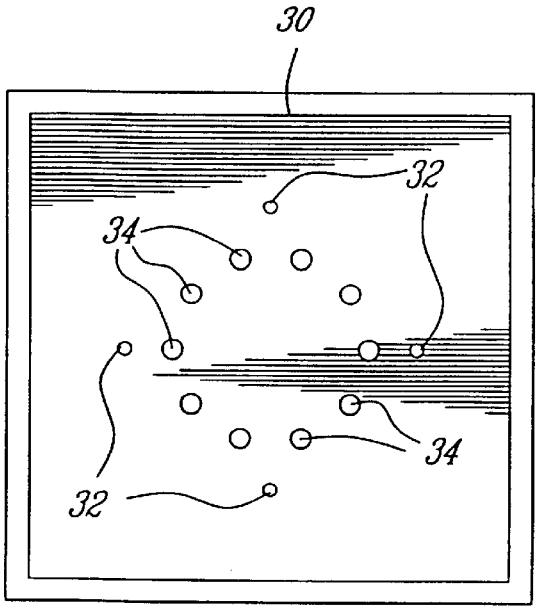
FIG. 11 is a plan view of an air injection system of the device illustrated in FIG. 9.

In a preferred embodiment, the fuel is a piece of wood that can be placed on the support surface 30 which may be a flat generally circular plate (FIG. 2) or a generally flat square or rectangular plate (FIG. 11), coupled to or sitting upon the air inlet chamber 14. Housing 16 rests upon the fuel support surface 30. To assist in positioning the housing 16 and tubular member 120, heat sink support 18 and the upper part of tubular member 120 comprise each a slot for engagement therein, and an annular flat ring 37 sitting on structure supporting plate 39 is provided to ensure proper positioning. Alternately, the fuel support surface 30 may include two or more bosses 32. The housing 16 is positioned over the bosses 32 and lowered onto the fuel support surface 30 where it is then aligned over the air inlet chamber 14. It should be noted that although wood is used as an example for fuel, other solid fuels like particulate fuels, powder fuels, liquid and gaseous fuels can also be employed. More specific examples include coal, natural gas, gasoline, kerosene etc.

Figure 5:
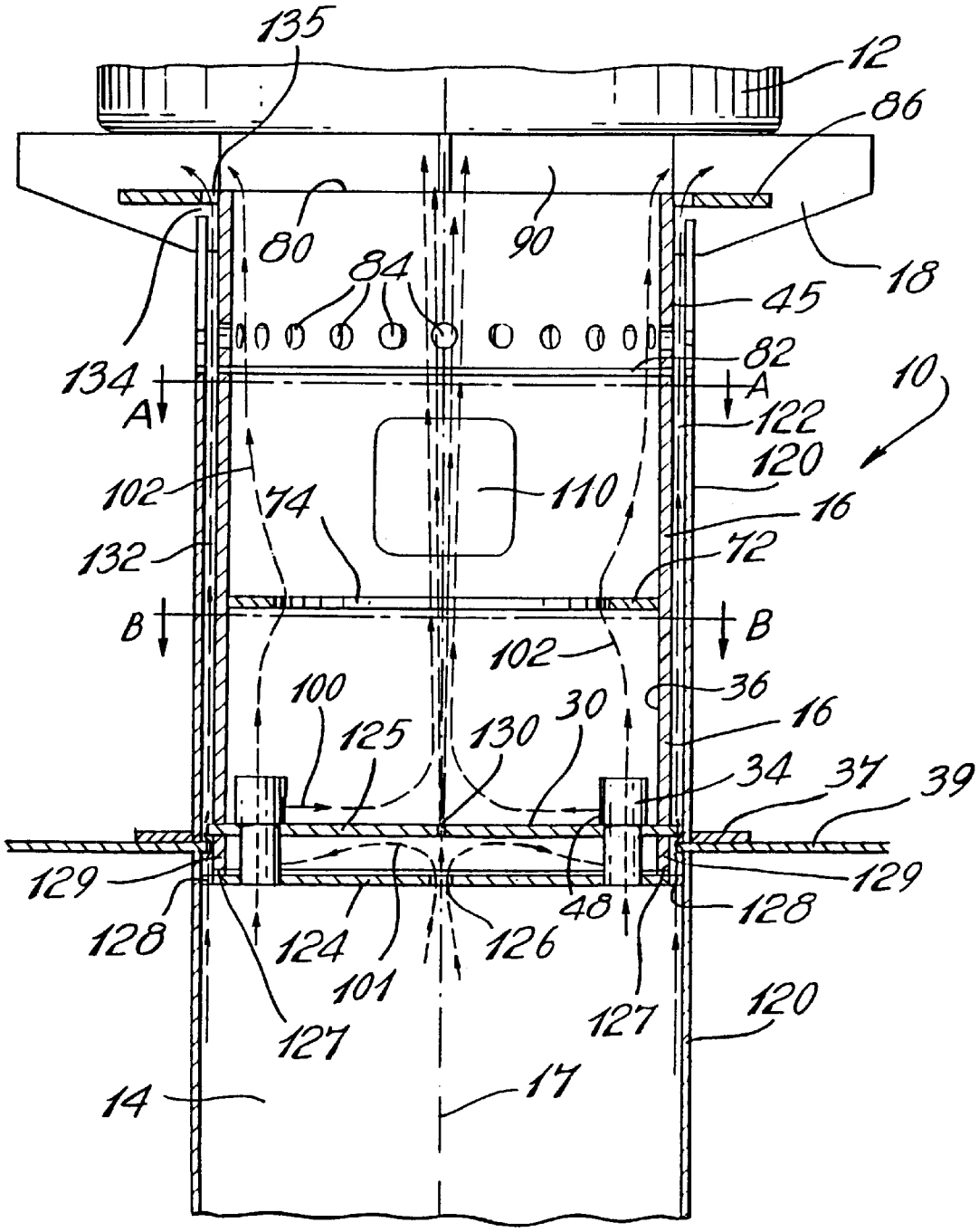
FIG. 5 is a vertical, sectional view similar to FIG. 1 showing the air flow patterns within the apparatus of FIG. 1.
Figure 6:
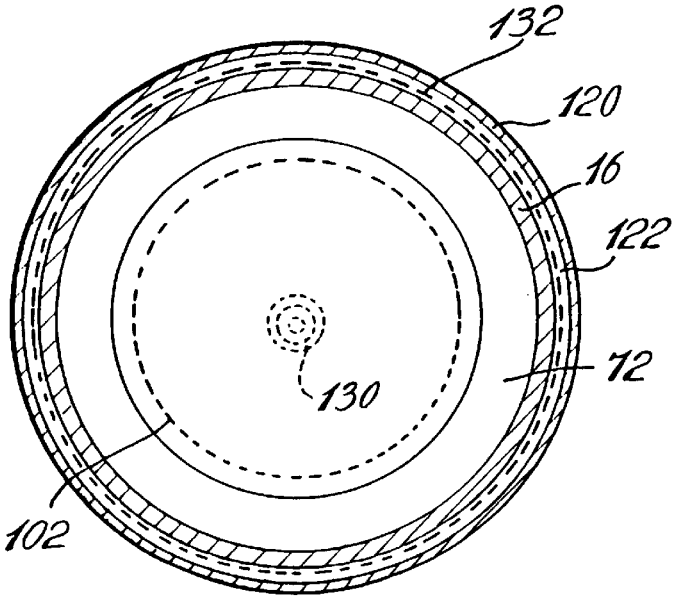
FIG. 6 is a cross-sectional view along the line A—A of FIG. 5.
Figure 7:
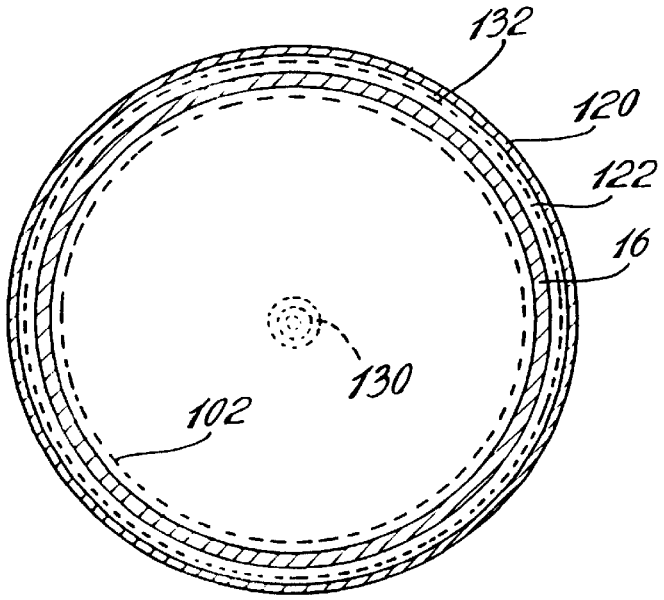
FIG. 7 is a cross-sectional view along the line B—B of FIG. 5.
Figure 8:
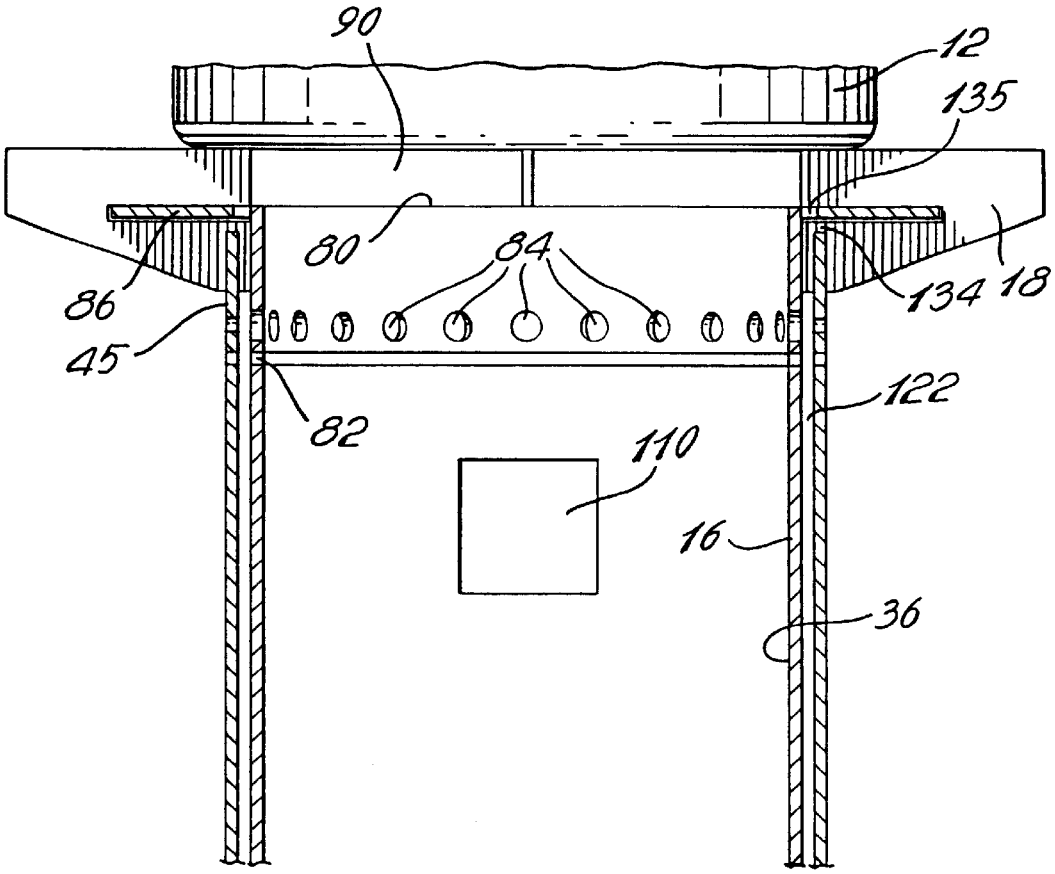
FIG. 8 is a vertical, sectional view of a further preferred embodiment according to the present invention.
Figure 9:
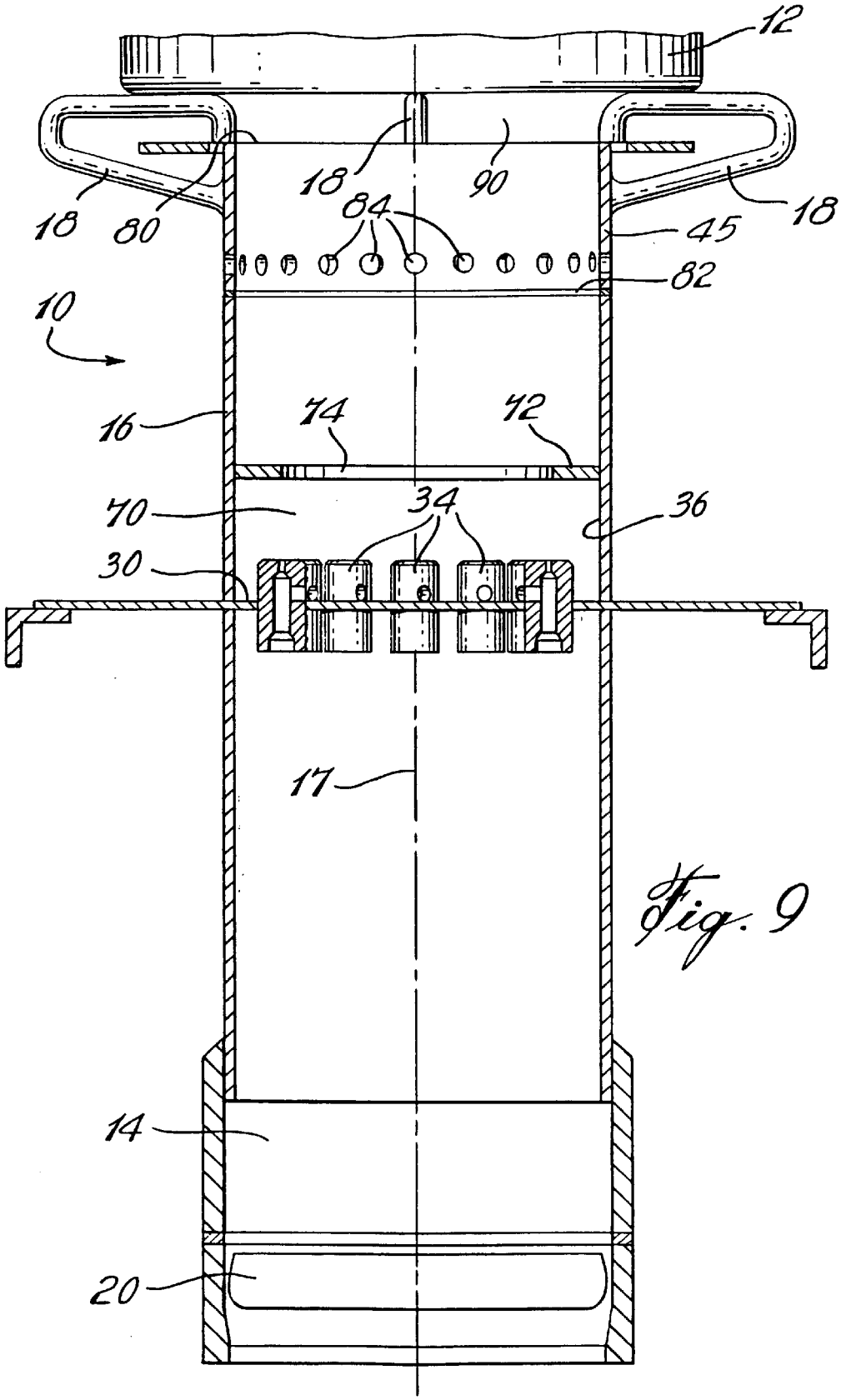
FIG. 9 is a vertical, section view of another embodiment of the device of the present invention.

Referring to the embodiment illustrated in FIGS. 1, 5 and 9, the support surface 30 further comprises a plurality of air injectors 34 located in a substantially circular array. The diameter of the array is slightly smaller than the interior diameter of housing 16 so that air injectors 34 are located substantially adjacent to the inner surface 36 of housing 16.

Figure 3:
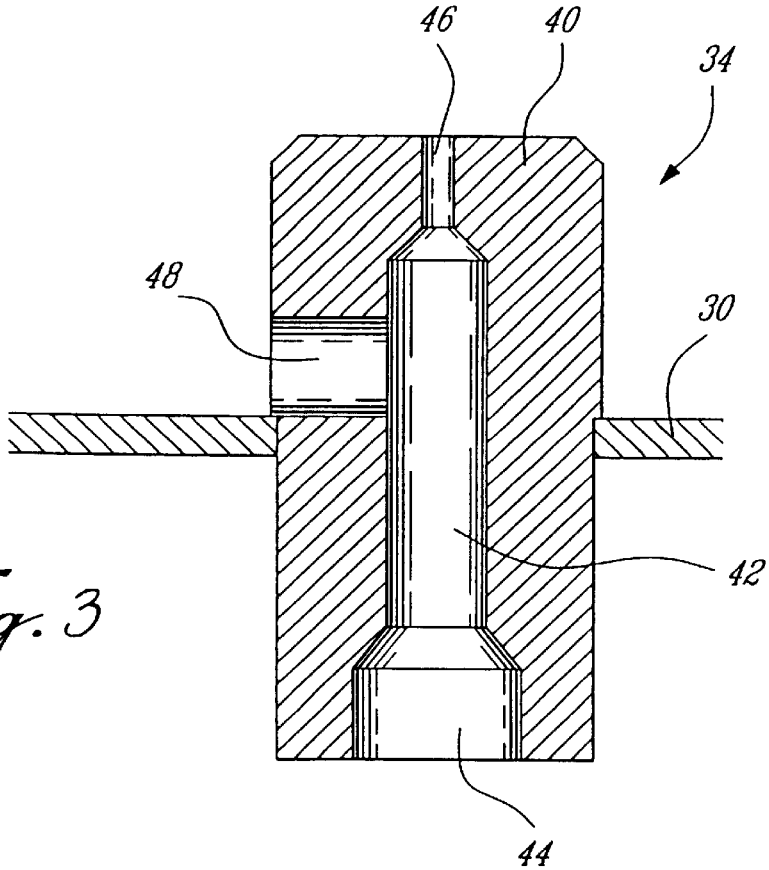
FIG. 3 is a vertical, sectional view of an air injector.

FIG. 3 illustrates a vertical cross-sectional view through an air injector 34. The air injector comprises a body 40 comprising itself a bore 42 extending longitudinally through the body 40 from an inlet end 44 to a first outlet 46 and a second outlet 48. First and second outlets 46 and 48 discharge air in directions that are substantially perpendicular to one another. First outlet 46 discharges air in a direction substantially parallel to axis 17 of housing 16. The second outlet 48 discharges air in a direction substantially perpendicular to axis 17 of housing 16. Preferably, the diameter of second outlet 48 is larger than that of first outlet 46. First outlet 46 is considerably smaller in cross-sectional area than bore 42 of injector 34, thereby ensuring that the air discharged from the first outlet 46 is speeded up to exit at a relatively high velocity compared to the is velocity at the inlet 44.

Figure 10:
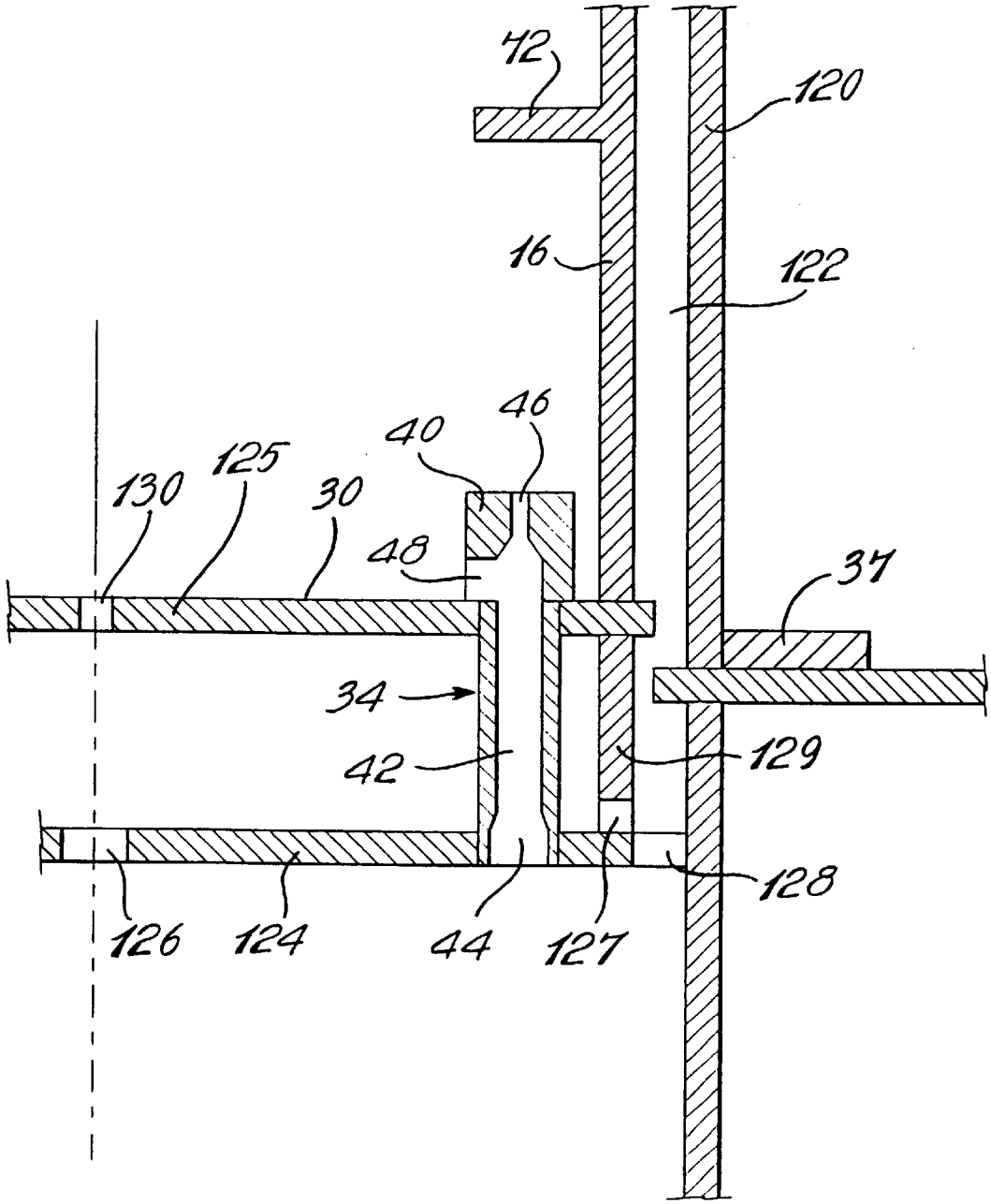
FIG. 10 is a second vertical sectional view of an air injector.

Second outlet 48 is substantially adjacent to fuel support surface 30 so that air discharged from that outlet travels across the fuel support surface 30 toward the fuel. In the embodiment of FIGS. 1 and 5, it will be seen that injector 34 extends through plates 124 and 125 and that second outlet 48 is substantially adjacent to plate 125 (see also FIG. 10).

Figure 4:
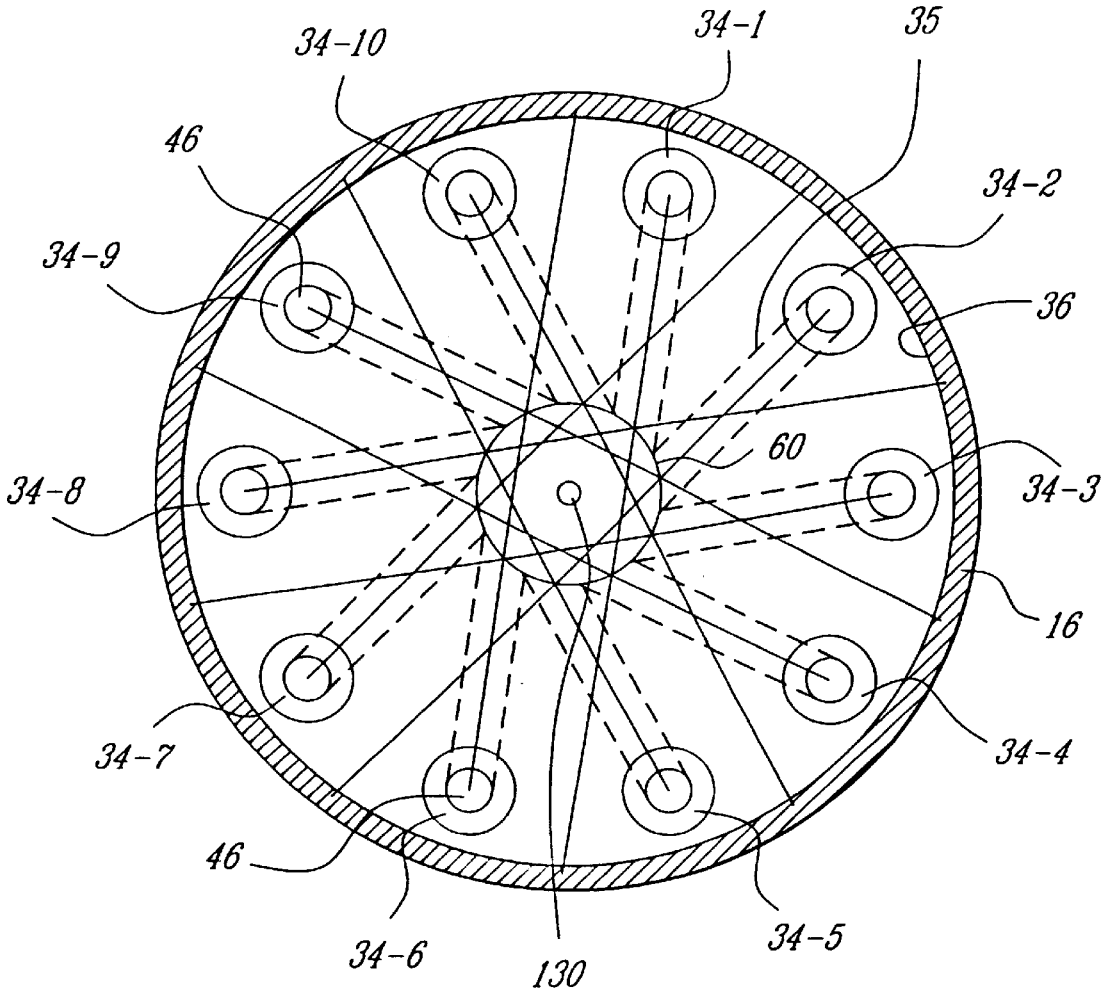
FIG. 4 is an plan enlarged view similar to FIG. 2 showing the air flow patterns from the injectors of FIG. 2.

FIG. 4 illustrates the flow pattern from the second outlets 48 of air injectors 34 arranged in a circular array. The air stream exiting the second outlet 48 extends in a plane generally perpendicular to axis 17. Each second outlet 48 is arranged to direct the exiting air to flow across fuel support surface 30 or plate 125 substantially along dotted line 35 as shown on FIG. 4. However, the direction of each exiting air stream is slightly shifted so that the stream is not directed to pass over axis 17. Air injector 34 identified 34-1 in FIG. 4 is substantially diametrically opposite to air injector 34-6. The direction of the air exiting second outlet 48 of injector 34-1 is directed to impinge on inner wall 36 midway between air injectors 34-5 and 34-6. Similarly, the direction of flow from the second outlet 48 of air injector 34-2 is across the fuel support surface to a point midway between injectors 34-6 and 34-7. Thus, the air flow of each injector is directed to the left of central axis 17, thereby creating a swirl within the combustion chamber. The flow pattern developed by the plurality of exiting air streams from the second outlets 48 thus develops a high pressure zone indicated generally by the circle 60.

Arrangements of the parts of the combustion chamber may be more clearly understood from reference to FIGS. 1 and 9. Housing 16 is generally cylindrical and has a central axis 17. The primary combustion zone is located immediately above fuel support surface 30 (FIG. 9) or plate 125 (FIGS. 1 and 5). Combustion takes place within the volume 70 defined by the tubular housing 16 between fuel support surface 30 or plate 125 and heat sink 12. Housing 16 comprises an annular restriction ring 72 coupled to inner surface 36 of housing 16. Annular ring 72 comprises a central aperture 74 preferably concentric with axis 17.

Housing 16 has an upper edge 80. Thus, the axial length of the combustion chamber contained within by the housing 16 is the length between fuel support surface 30 (FIG. 9) or plate 125 (FIGS. 1 and 5) and heat sink 12. The location of restriction ring 72 within housing 16 is such that optimum flame height and heat transfer to the heat sink are achieved.

Above ring 72, housing 16 comprises a thermal break at 82 that may be in the form of an air gap with the portion of the housing above the air gap being separated from the portion below the air gap by relatively narrow metallic components. Alternatively, the thermal break may be in the form of a ceramic or other material that would inhibit the flow of heat from the upper portion of the combustion chamber to the lower portion thereof below the thermal break.

Housing 16 may further comprise a plurality of pressure release apertures 84, preferably holes, provided circumferentially through the wall of housing 16. These are located above thermal break 82 but below upper edge 80 of housing 16.

As shown in the drawings, apparatus 10 comprises a heat sink support 18 located on the housing 16 adjacent the upper edge 80. In a preferred embodiment, heat sink support 18 comprises a plurality of metallic rails projecting slightly above upper edge 80 and coupled to the outer surface 45 of housing 16. Furthermore, a flat annular ring 86 is coupled to upper part 80 of housing 16. The beforementioned rails are arranged circumferentially around housing 16 and serve to support heat sink 12. When heat sink 12, in this case a cooking utensil, is placed over support 18, a heat transfer gap 90 is defined. Combustion products which travel upwardly within housing 16 impinge directly upon heat sink 12 and then pass through heat transfer gap 90 to exit from heating apparatus 10. As the combustion gases pass through heat transfer gap 90, they are forced to travel along a portion of the periphery of heat sink 12 moving radially outwardly along the bottom surface of heat sink 12. To facilitate this heat transfer process, heat sink 12 is preferably larger than the diameter of housing 16. Thus, heat transfer gap 90 is effectively toroidal in shape.

As seen in FIG. 5, the dotted lines indicated at 100 represent the flow of air passing out through second outlets 48 of air injectors 34. As the air exits second outlets 48, it travels substantially parallel to the plane of plate 125. As air impacts on the fuel or other air streams from an opposing injector 34, it swirls and passes upwardly in the combustion chamber. This swirling or turbulent air will be mixed with the gases released by the burning fuel and will form the combustion products.

Dotted lines 102 illustrate the air flow pattern for the air exiting first outlet 46 of air injectors 34. The air flow from aperture 130 provides additional air needed for a better combustion at the central zone of the combustion chamber. The air flowing in the pattern 102 comprises the air exiting first outlets 46 of air injectors 34. The air flowing out of first outlets 46 thus forms a substantially cylindrical air envelope. That air envelope exits first outlets 46 travelling substantially parallel to axis 17 of housing 16. The air stream 102 then impinges upon restriction ring 72, which causes the air flow 102 to divert slightly radially inwardly to pass through a circular aperture 74 defined by the restriction ring 72. Thereafter, the air flow bends radially outwardly and passes axially upwardly along housing 16.

Air flow pattern 102 thus forms an envelope confining the combustion gases generated by air flow 100 and combustion products released from the fuel on fuel support 30. Air flow 102 is thought to serve three purposes. Firstly, the air envelope provides an envelope for the swirling combustion gases above the fuel. Secondly, it provides a cooling effect limiting heat transfer to housing 16. And thirdly, it assists in transferring heat to the heat sink. The air stream coming out of aperture 126 cools plate 125 and mixes with the air flow incoming from apertures 128 to produce air stream 132. The presence of air stream 132 between housing 16 and external tubular member 120 further reduces heat transfer to the external surface thereof.

The air stream coming out of aperture 130, and air streams 100 and 102, together with the gases released during the combustion process of the fuel, travel upwardly and impinge upon heat sink 12. Thereafter, the gases exit housing 16 by passing through heat transfer gap 90 and in addition, to a minimal extent, through the pressure release apertures 84, if any are present. In order to favor the heat transfer to the sink, the total area available for flow through heat transfer gap 90 is preferably larger than the area of aperture 74 defined by restriction ring 72. In addition, little gas passes through apertures 84, if any, to relieve the pressure at the upper portion of the combustion chamber, which may thus increase the temperature in the area just below the heat sink.

The present invention enables extremely efficient heating of the heat sink for a number of different reasons. Fan 20 forces air into the combustion zone through air injectors 34. This means that the fuel is burnt in an area being at a pressure higher than ambient pressure. Thus, burning of the fuel occurs under pressures slightly higher than ambient. The higher pressure in the area of the fuel appears to provide a lowered ignition and combustion temperature, which in turn means that the rate of gasification from the fuels is slowed. In addition, the cylindrical air curtain formed by flow pattern 102 cools the combustion gases as combustion continues, keeping the combustion gases below the temperature at which $NO_x$ and other pollutants are generated. This also helps in providing a more complete combustion of the fuel.

Restriction ring 72 within housing 16 assists in the transfer of the combustion gases released in what may be considered to be a primary combustion zone, and in moving the heat released directly towards the heat sink. Because of the location of the restriction ring 72, there is a tuning effect within the length of the combustion chamber that also appears to favor movement of the heat generated by combustion in the general direction of the heat sink. The uppermost portion of housing 16 will be at the lowest temperature. Any heat lost through the wall of housing 16 represents loss of heat that otherwise should be directed toward heat sink 12. Thermal break 82 tends to minimize the transfer of heat from the upper portion of housing 16 to the lower portion thereof and air flow pattern 102 tends to move heat from the combustion gases quickly and efficiently upwardly toward the heat sink so that the amount of heat lost through the wall of housing 16 is reduced.

The present invention provides particularly efficient cooking using small blocks of wood. To start the use of the apparatus, a small piece of wood or kindling is placed on fuel support surface 30 or plate 125 inside the circular array formed by injectors 34. After initiation of fire, fan 20 is turned on, and housing 16 is placed over the support surface. If a tubular member 120 is present around housing 16, both of these are placed over the support surface jointly. As the wood piece is consumed, more wood can be added, for example through an aperture 110 located above restriction ring 72. The amount of air to be delivered in the chamber is adjusted with an air flow valve (not shown).

As shown in FIG. 3, the area of first outlet 46 of each injector 34 is preferably considerably smaller than the area of second outlet 48. However, outlet 48 is positioned substantially perpendicular to bore 42 passing centrally through the body 40 of the injector. It is desired that the air passing through the first outlet 46 be moving relatively quickly, and that sufficient air passes through the plurality of first outlets 46 to form the air flow pattern 102.

Housing 16 and air chamber 14 is preferably made of a highly thermal conductive material such as stainless steel. Fuel support surface 30 and plates 124 and 125 may also be made of stainless steel. Further, air injectors 34 should be evenly distributed about a circular array and the distance from the array to the interior surface of housing 16 is approximately 1 mm to ensure an efficient swirl within the combustion chamber. The air injectors themselves may also be made from stainless steel. Experimental evidence shows that preferred air flow and air flow patterns are achieved when the area of first outlets 46 compared to the area of second outlets 48 is between 12 and 18%. It is considered that the area of second outlets 48 compared to first outlets 46 may be as high as 20 to 1. Of course the ratio of areas could be considerably less.

An example of a fan 20 suitable for the purposes of the present invention is a 4715FSB30™ manufactured and sold by NMB Technologies. Preferably, fan 20 is isolated from the heat generated by the fuel burning on the support surface. In addition, to minimize heat flow conducted along the wall of air inlet chamber 14, the housing for fan 20 may be spaced from the air inlet chamber 14 by an air gap, thereby adding to the thermal isolation of the fan.

One of the more interesting observations is that there does not appear to be any substantial flow through aperture 110 provided in housing 16 for addition of fuel. As shown in FIG. 5, the flow pattern 102 bends inwardly, upwardly of the restriction ring 72. It has been observed that essentially no flame passes outwardly through the open aperture 110. Similarly, there is been no substantial flow through pressure relief apertures 82. The flow of gases travelling through the restriction ring, $Q_{ring}$, is thus equal to the area of the ring, $A_{ring}$, multiplied by the velocity at which the gases are travelling through the ring.

Heat sink support elements 18 support heat sink 12 so as to define a gap between the heat sink and the housing. Because of the configuration of the present device, the gases at the exit are travelling slightly slower than at the ring as they pass through aperture 74. The exit velocity through the thermal transfer gap 90 can be reduced is further by increasing the area of the thermal transfer gap 90 while keeping the distance between the support surface 30 and the lower surface of the heat sink 12 constant.

In understanding the processes occurring within the combustion chamber, this might more easily be explained and understood as a fluid dynamics process.

The cooling air element illustrated by the flow pattern 102 desirably travels upwardly at approximately the same speed as the combination of flame and combustion gases. The exit speed of the combined gases through the thermal transfer gap 90 is reduced slightly to allow the heat to remain as long as possible adjacent the base of the heat sink. The swirl generated inside the combustion chamber causes the flame and combustion gases to remain substantially within the central portion of housing 16, thereby concentrating the greatest portion of the heat centrally of the under side surface of the heat sink. Upon impinging the heat sink, the heat is therefore substantially uniformly diffused on the surface thereof.

In the device of the present invention, the maximum temperature measured inside the combustion chamber when operating with wood as the fuel, was 950° C. at the centre of support surface 30.

While the invention has been described in connection with specific embodiments thereof, it will be understood that it is capable of further modifications, and this application is intended to cover any variations, uses or adaptations of the invention following, in general, the principles of the invention, and including such departures from the present description as come within known or customary practice within the art to which the invention pertains, and as may be applied to the essential features hereinbefore set forth, and as follows in the scope of the appended claims.

What is claimed is:

1. A heating apparatus for generating and transferring heat to a heat sink comprising:

a tubular combustion chamber for combusting a fuel therein, thereby generating heat, the combustion chamber comprising a lower portion provided with a bottom surface, and an open upper portion;

air injecting means coupled to the combustion chamber for injecting air therein while the fuel is combusting, the air injecting means being coupled to the combustion chamber in a manner such that upon injection of air, a first flow of air substantially swirls towards the upper portion of the combustion chamber and a second flow of air flows substantially parallel to an inner wall of the tubular combustion chamber towards the upper portion whereby the heat is transferred to the heat sink in intimate contact with the combustion chamber;

the combustion chamber is disposed over the air injecting means, and said air injecting means is comprised of a series of air injectors extending from an air inlet chamber into the combustion chamber.

2. The apparatus according to claim 1 wherein the series of air injectors are provided at an equal distance from each other around the combustion chamber.

3. The apparatus according to claim 2 wherein each air injector comprises an inlet wherein the air is injected from the air inlet chamber, a first outlet and a second outlet, the first outlet allowing injection of air towards the upper portion of the combustion chamber in a manner substantially parallel to the inner wall thereof, and the second outlet allowing injection of air towards the middle of the combustion chamber in a manner substantially parallel to the bottom surface of thereof.

4. The apparatus according to claim 3 wherein the diameter of the first outlet is smaller than the diameter of the second outlet.

5. The apparatus according to claim 1 further comprising a support coupled to the upper portion of the combustion chamber, and the support being adapted to receive the heat sink thereon.

6. The apparatus according to claim 5 wherein the support extends over an upper rim of the upper portion of the combustion chamber.

7. The apparatus according to claim 6 wherein the combustion chamber comprises a series of apertures in the inner wall thereof, and the apertures being substantially equally spaced apart circumferentially and being provided between the upper edge of the combustion chamber and an upper rim of the support.

8. A process of generating and transferring heat comprising the steps of:

providing a combustion chamber, the combustion chamber comprising an open upper portion and a bottom surface, and wherein a fuel is provided therein;

injecting air into the combustion chamber while the fuel is combusting, the air being injected in a manner such that a first flow of air substantially swirls towards the upper portion of the combustion chamber and a second flow of air flows substantially parallel to an inner wall of the combustion chamber towards the upper portion thereof whereby the heat is transferred to a heat sink in intimate contact with the combustion chamber; said air injection is carried out from underneath the combustion chamber through a series of air injectors extending from an inlet air chamber into the combustion chamber, the air injectors being disposed at an equal distance from each other around the bottom surface of the combustion chamber;

each of said injectors comprises an inlet wherein the air is injected from the air inlet chamber and a first outlet and a second outlet, the first outlet allowing the injection of air towards the upper portion of the combustion chamber is a manner substantially parallel to the inner wall thereof, and the second outlet allowing the injection of air towards the middle of the combustion chamber in a manner substantially parallel to the bottom surface of the combustion chamber.

9. The process according to claim 8 wherein the diameter of the first outlet is smaller than the diameter of the second outlet.

10. The process according to claim 8 wherein the inner wall comprises a ring extending perpendicularly thereof, thereby forming an opening having a diameter smaller than the diameter defined by the upper portion of the combustion chamber.

11. The process according to claim 8 wherein the heat sink is provided on a support coupled to the upper portion of the combustion chamber, and the support being adapted to receive the heat sink thereon.

12. The process according to claim 8 wherein the combustion chamber comprises a series of apertures in the inner wall thereof, and the apertures being substantially equally spaced apart circumferentially and being provided between an upper edge of the combustion chamber and an upper rim of the support.

* * * * *